US005632169A

United States Patent [19]

Clark et al.

[11] Patent Number: 5,632,169

[45] Date of Patent: May 27, 1997

[54] SELF POWERED ELECTRONIC COMBINATION LOCK HAVING COMPREHENSIVE MONITORING OF POWER LEVELS FOR VARIOUS FUNCTIONS

[75] Inventors: Michael R. Clark, Lexington, Ky.; Christian F. Mascaro, Bowie, Md.

[73] Assignee: Sargent & Greenleaf, Nicholasville, Ky.

[21] Appl. No.: 470,272

[22] Filed: Jun. 6, 1995

Related U.S. Application Data

[62] Division of Ser. No. 143,223, Oct. 29, 1993.

[51] Int. Cl.[6] ..... E05B 49/00

[52] U.S. Cl. ..... 70/278; 70/303 A; 70/333 R; 340/825.31; 361/172

[58] Field of Search ..... 70/275–278, 267, 70/268, 272, 274, 22–29, 302, 303 A, 303 R, 306, 310, 312, 321, 322, 329–333 A, 333 R; 292/348, 349, 353; 340/527, 529, 542, 543, 547, 825.31, 825.32, 825.34, 825.5; 361/72, 75, 89, 92, 171, 172; 403/335, 336

[56] References Cited

U.S. PATENT DOCUMENTS

| | | | |
|---|---|---|---|
| 3,600,643 | 8/1971 | Losey . | |
| 3,699,789 | 10/1972 | Potzick . | |
| 3,812,403 | 5/1974 | Gartner . | |
| 3,835,680 | 9/1974 | Evans . | |
| 3,878,511 | 4/1975 | Wagner . | |
| 3,950,678 | 4/1976 | Brewer . | |
| 4,038,846 | 8/1977 | Klann . | |
| 4,148,092 | 4/1979 | Martin . | |
| 4,190,785 | 2/1980 | Kompanek . | |
| 4,197,726 | 4/1980 | Uyeda . | |
| 4,433,355 | 2/1984 | Chew et al. . | |
| 4,477,806 | 10/1984 | Mochida et al. . | |
| 4,479,112 | 10/1984 | Hirsch . | |
| 4,631,940 | 12/1986 | Krivec et al. . | |
| 4,684,945 | 8/1987 | Sanderford, Jr. . | |
| 4,745,784 | 5/1988 | Gartner | 70/303 A X |
| 4,831,851 | 5/1989 | Larson . | |
| 4,855,862 | 8/1989 | Wainio et al. | 361/72 |
| 4,904,984 | 2/1990 | Gartner et al. | 70/333 R X |

(List continued on next page.)

FOREIGN PATENT DOCUMENTS

| | | |
|---|---|---|
| 0 021 670 A1 | 1/1981 | European Pat. Off. . |
| 2 533 340 | 9/1982 | France . |
| 3208818 | 3/1982 | Germany . |
| 2 175 638 | 3/1986 | United Kingdom . |
| WO80/02710 | 12/1980 | WIPO . |

*Primary Examiner*—Suzanne L. Dino
*Attorney, Agent, or Firm*—Reid & Priest

[57] ABSTRACT

A user of a self-powered electronic combination lock rotates an outer dial to cause generators to generate energy for storage in a capacitor bank. The user then rotates an inner dial to cause a microcontroller to sequentially display a combination of numbers, and presses the inner dial to select a displayed number. The microcontroller determines direction and extent of motion of the inner dial by receiving signals derived from Wiegand sensors placed in proximity to a magnetized disc which rotates integrally with the inner dial, and controls the display of numerals on an LCD display accordingly. When the microcontroller determines that a correct combination has been entered, it activates a motor to move a motor cam to act directly on a locking lever so that the locking lever can engage a drive cam integrally linked with the inner dial, to allow the inner dial to withdraw the lock's bolt. Software features, as well as power level monitoring features, cause the locking lever to be moved away from the drive cam to prevent the bolt from being withdrawn if it has not already been withdrawn within a given time window. Integral bearing/retaining members make the lock dials tamper-evident. After a given number of successive incorrect combination entries, an "override" combination, which is preferably a longer, mathematical variation of normal combinations, is necessary to open the lock.

13 Claims, 9 Drawing Sheets

U.S. PATENT DOCUMENTS 4,912,460 3/1990 Chu .
4,951,171 8/1990 Tran et al. ..... 361/92 X
4,972,182 11/1990 Novik et al. ..... 70/278 X
4,977,765 12/1990 Legault et al. .
5,061,923 10/1991 Miller et al. ..... 340/825.31
5,184,491 2/1993 Schittenhelm .
5,265,452 11/1993 Dawson et al. .
5,268,811 12/1993 Maeda ..... 361/172
5,271,253 12/1993 Cassada et al. ..... 70/333 R X
5,307,656 5/1994 Gartner et al. .
5,410,301 4/1995 Dawson et al. ..... 340/825.31

SELF POWERED ELECTRONIC COMBINATION LOCK HAVING COMPREHENSIVE MONITORING OF POWER LEVELS FOR VARIOUS FUNCTIONS

This is a divisional of U.S. application Ser. No. 08/143,223, filed Oct. 29, 1993.

BACKGROUND OF THE INVENTION

1. Field of the Invention

The invention relates to the electronic combination locks. More specifically, the invention relates to electronic combination locks in which an assembly of mechanical elements and computer-implemented processes provide a wide range of features.

2. Related Art

Various lock designs are known in the art. Conventionally, locks have been purely mechanical in design. However, with the development of reliable integrated circuits and microprocessors, more sophisticated and functional lock devices have become possible. However, even historically sophisticated electronic lock designs have failed to provide a number of desirable features.

Desirable features include the ability to be self-powered, so that correct operation of the lock is not prevented during power failures or battery failures. Whereas certain self-powered locks are known in the art, their designs suffer from the possibility that the self-charging function can interfere with the combination entry function.

Also, it is desirable that locks be tamper-evident and resistent to physical attack. Also, it is desirable to reduce the number of components in a lock, so as to enhance simplicity and promote reliability. Known locks have not adequately reduced the number of components, such as in the components used for bearing and retaining a combination dial, or in a mechanism used to act directly on the linkage to the bolt. Typically, known locks have involved gears which are unnecessarily complex and prone to failure.

It is also desirable to avoid a situation in which a user enters a correct combination, and thus enables the bolt to be withdrawn, but for some reason leaves the lock unattended so that some other unauthorized individual may open the lock. It is desirable to prevent an unauthorized person from opening the lock after the authorized person, who entered a correct combination, has departed.

Along a similar line, especially pertinent to self-powered locks which have a limited power storage capacity, it is desirable to ensure that there is sufficient energy to prevent any person from opening the lock if there is not enough power to operate the lock correctly. However, conventional locks have overlooked these features.

It is especially desirable in self-powered locks to use components which consume a minimum amount of power. Among the components of conventional locks which unnecessarily consume power are the sensors which sense motion and rotation of the combination dial. Conventional lock designs have overlooked a feature of reducing unnecessary power consumption in this area.

It is also desirable to provide a combination lock in which, after a person has entered a given number of combinations which are incorrect, it is made even more difficult for the user to open a lock. This feature is based on the premise that an unauthorized individual (or a rapid dialling machine) attempting to open the lock without knowing the correct combination will first enter several combinations incorrectly. However, conventional lock designs have not implemented this desirable feature that, based on an apparent attempt by an unauthorized user to open the lock, it should be made even more difficult for the user to open the lock.

Thus, conventional lock designers have overlooked many features, and combinations of features, which would provide a versatile, convenient, tamper-evident, reliable, power-efficient, electronic combination lock. It is to meet these demands that the present invention is directed.

SUMMARY OF THE INVENTION

The present invention provides a variety of features which overcome limitations of known locks, including electronic combination locks.

According to a first aspect of the invention, a dual dial arrangement is provided, including a first dial which is turned to generate power, and a second dial which rotates to generate numbers to represent the dial position. As an additional feature, the second dial can be pushed to input a selected displayed number as a combination entry.

Thus, the invention provides an arrangement of controls on a combination lock, the arrangement comprising means for recognizing a combination and for allowing opening of the lock, when power is provided, means for storing and providing power to the recognizing means, a first control structure, accessible from outside the lock, which is movable by a user to provide power to the storing means, and a second control structure, accessible from outside the lock, which is movable by the user separately from the first control structure to determine the combination.

According to a second aspect of the invention, means are provided for retaining the first and second dials, which function both as bearings for the dials, and as retaining members for the dials, so that the combination lock is tamper-resistant and tamper-evident.

Thus, the invention provides an arrangement for bearing and retaining at least one externally accessible rotatable dial on a combination lock. The arrangement comprises a support structure, the rotatable dial, and an integral bearing/retaining member, affixed to a first one of the support structure or dial, the member including a clip which matingly engages a slot in a second of the support structure or dial so that the clip cannot be removed from its mating engagement with the slot without causing visible damage.

According to a third aspect of the present invention, a motorized earn directly acts on a locking lever, so that the lock bolt is mechanically drawn by the lock dial.

Thus, the invention also provides an arrangement within a lock, comprising a motor, a motor cam which is directly responsive to turning of the motor, a bolt which is extendable out of and withdrawable into the lock, and a locking lever which is operatively connected to the bolt and which is directly contacted by the motor cam and directly responsive to the motor cam so as to be moved into and out of an "engage" position in which the bolt may be extended or withdrawn from the lock.

According to a fourth aspect of the present invention, a timeout period is provided after a correct combination has been entered. If the bolt has not been withdrawn during the timeout period, the invention prevents it from being withdrawn, until a correct combination has again been entered.

Thus, the invention further provides an arrangement within a lock, comprising a bolt capable of being extended from or withdrawn into the lock, means for entering an input combination, and a controller. The controller includes means for comparing the input combination with at least one correct combination and for determining a match therebetween, means for forming a time window after the match is determined, and means for enabling the bolt to be withdrawn only during the time window.

A fifth aspect of the invention provides a scheme of monitoring power supply voltages within the lock. For example, if insufficient power is available to operate the lock, the monitoring feature prevents the lock from attempting to operate at all. Preferably, this monitoring is performed in a flexible manner using a programmed microcontroller such as one including a microprocessor CPU.

Thus, the invention also provides a self-powered lock comprising a bolt capable of being extended from and withdrawn into the lock, and means, responsive to entry of a correct combination, for enabling the bolt to be withdrawn into the lock. The enabling means has an "engage" position in which the bolt can be withdrawn into the lock and a "disengage" position in which the bolt cannot be withdrawn into the lock. The lock also has means for storing energy for operation of certain components of the lock, means for monitoring an energy level of the storing means, and means, responsive to the monitoring means, for preventing the enabling means from moving from its "disengage" position to its "engage" position if the monitored energy level is below a given energy threshold. The given energy threshold is greater than or equal to an amount of energy required to subsequently move the enabling means from its "engage" position to a "disengage" position after a predetermined time period.

According to a sixth aspect of the present invention passive magnetic sensors are used to sense movement of a dial, and, in combination with other circuitry, determine the direction of dial movement.

Thus, the invention further provides a self-powered lock comprising a movable dial, accessible from outside the lock for a user to select an input combination, means for generating and storing energy, a magnetized element, moving in response to the dial's movement, a Wiegand sensor placed with respect to the magnetized element for generating signals indicative of movement of the magnetized element, and a controller, powered by the energy from the storing means, for interpreting the signals from the Wiegand sensor and for controlling operation of the lock.

According to a seventh aspect of the present invention, after a given number of successively-entered, incorrect combinations have been made, a "lockout state" is entered in which the lock is prevented from opening, even if a correct combination is entered. An "override" combination is provided to end the lockout state.

Thus, the inventon provides a combination lock capable of operating in (1) a normal mode in which at least one first combination allows the lock to be opened and (2) a lockout mode in which at least one second combination allows the lock to be opened, wherein the at least one first combination differs from the at least one second combination. The lock comprises means for receiving an input combination, means for comparing the input combination with the at least one first combination, means for counting a number of successively-entered incorrect input combinations which do not match a valid first combination, and means, responsive to the counting means when the counting means determines that a given threshold number of successively entered incorrect combinations have been encountered, for changing the operational mode of the lock into the override mode.

According to still another aspect of the present invention, power storage for DC operation of various components of a lock are separated, so that available power for a given function may be monitored, and selected monitored power depletion may thus govern operation of the lock.

According to still another aspect of the invention, data is sent serially from a processor to a combination number display, to minimize the number of pathways passing through the door of the security container.

According to a further aspect of the invention, switches which detect bolt position and the position of the dial which is pushed to choose combination numbers, are provided with pivot posts and overtravel springs, to minimize damage to the switch case.

Other objects, features, and advantages of the invention will be apparent to those skilled in the art, upon reading the following Detailed Description of the Preferred Embodiments in conjunction with the accompanying in the drawing figures.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
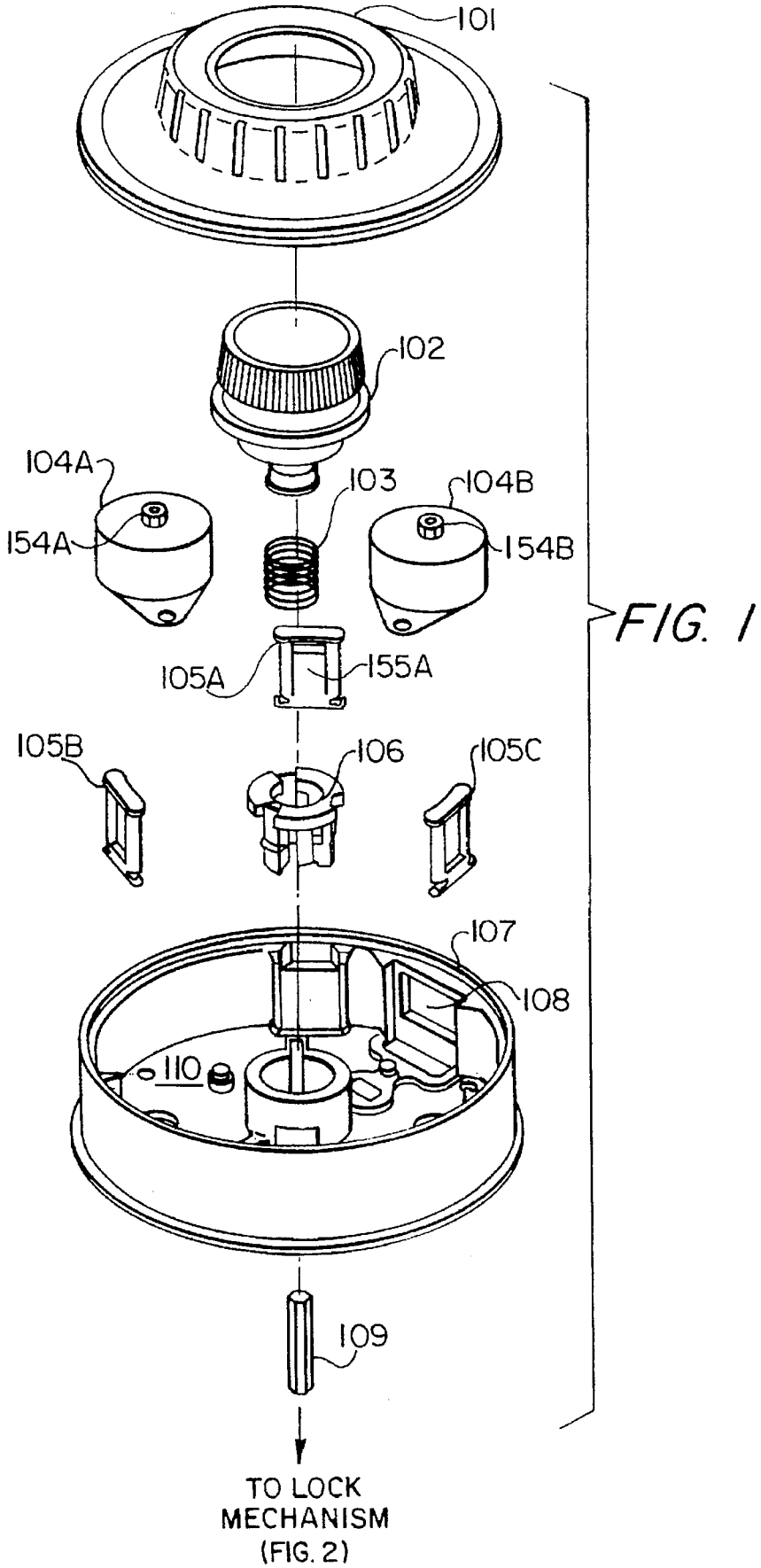
FIG. 1 is an exploded perspective view of a dial assembly according to a preferred embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. For example, the terms "upper", "lower", "above", "below", "clockwise", "counter-clockwise", and the like, are used for purposes of explaining a preferred embodiment illustrated in the accompanying drawings, but should not be interpreted as limiting the claims which follow this specification.

FIG. 1 illustrates in exploded perspective view a preferred dial assembly according to the present invention.

Figure 8:
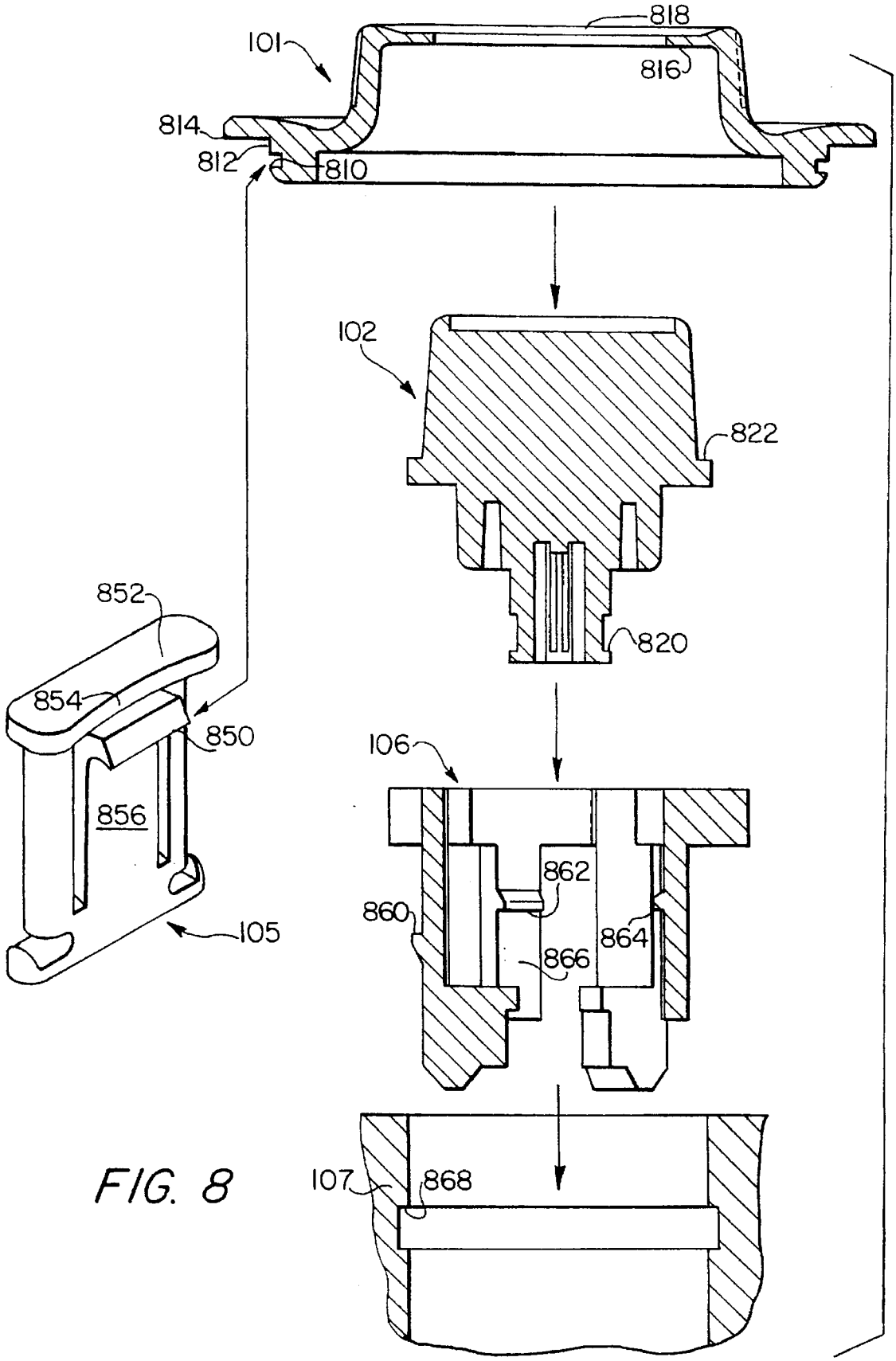
FIG. 8 schematically illustrates various elements from FIG. 1, not necessarily to the same scale, to demonstrate the tamper-evident features of the present invention.

A dial ring 107 houses and supports the elements of the dial assembly. An outer dial 101 is positioned concentrically atop the dial ring, and is supported on it by three bearings, illustrated as elements 105A, 105B, and 105C. The bearings, collectively referred to herein as element 105, fit in an annular slot (not visible in FIG. 1) in the bottom side of outer dial 101. The beatings 105 are provided with retaining clips, which may be leaf springs, one of which is visible in FIG. 1, as element 155A. Bearings 105 are first retained in the dial ring 107, and outer dial 101 snaps into place. As the outer dial snaps into place, the bearings fit in the annular slot in the bottom of the outer dial, snapping in place through the action of retaining clips 155A. FIG. 8 illustrates the details of this arrangement in greater detail.

Thus, after the outer dial is snapped in place, the lock mechanism is less susceptible to physical attack, as the dial is retained by its bearings. Should an individual forcibly remove the dial after it is mounted on the bearings, the bearings and dial would be visibly damaged, leaving evidence of the attempted entry or vandalism.

The invention also provides one or more generators 104A, 104B, which are secured to the dial ring 107. The generators 104A, 104B are provided with respective rotary gear members 154A, 154B. Teeth on the periphery of gear members 154A, 154B interlock with an annular gear (not shown) on the bottom side of outer dial 101.

In operation, as outer dial 101 is turned, the teeth on its annular gear turn the gear members 154A, 154B so as to cause respective generators 104A, 104B to generate alternating current (AC) electricity. As will be described in greater detail below, the generators provide electricity to a bank of energy storage devices for providing power to those components of the electronic lock which require electric power to function. These components include, for example, a central processing unit (hereinafter "CPU"), liquid crystal display (hereinafter "LCD"), and associated circuitry, to be described with reference to FIGS. 3A and 3B.

The dial assembly is also provided with an inner dial 102. During assembly, a dial bearing 106 is fixed to the dial ring 107. As the inner dial 102 is snapped into place, the dial bearing 106 snaps into an annular slot (not visible) on the underside of the inner dial. A spring 103, which may be a cylindrical compression spring, urges inner dial 102 away from the dial ring.

In the same manner as bearings 105 retain outer dial 101 as described above, dial bearing 106 retains inner dial 102 in position in the dial assembly. As the dial bearing 106 is preferably made of a molded material, such as DELRIN™, the arrangement of the bearing and inner dial is tamper-evident, should an individual attempt to forcibly remove the inner dial or vandalize that portion of the apparatus. The details of this arrangement are illustrated in FIG. 8, discussed below.

After assembly, inner dial 102 is arranged concentrically with outer dial 101, and both are rotatably positioned atop the dial ring 107.

In operation, dials 101,102 may be freely rotated on their respective beatings. As will be described in greater detail below, the outer dial is rotated to generate alternating current electrical power which is later rectified to charge banks of capacitors. The capacitors store power to operate the electronic circuitry, and rotate a cam to allow unlocking and re-locking of the lock assembly. The inner dial, on the other hand, is rotated so as to cause the CPU to make the LCD display a number, and is pushed in by the user against the force of spring 103 so as to select a particular number which is displayed; the inner dial is also used to mechanically retract the lock's bolt.

In FIG. 1, the LCD display is placed behind a window 108, and a printed circuit board is located at a position 110. Suitable interfaces are provided between the elements rotating with the inner dial, the printed circuit boards, the LCD display, and between the outer dial and the capacitor bank. The physical and electrical interconnection of elements is not central to the invention, and may readily be implemented by those skilled in the art, so that further discussion thereof is omitted.

Figure 2:
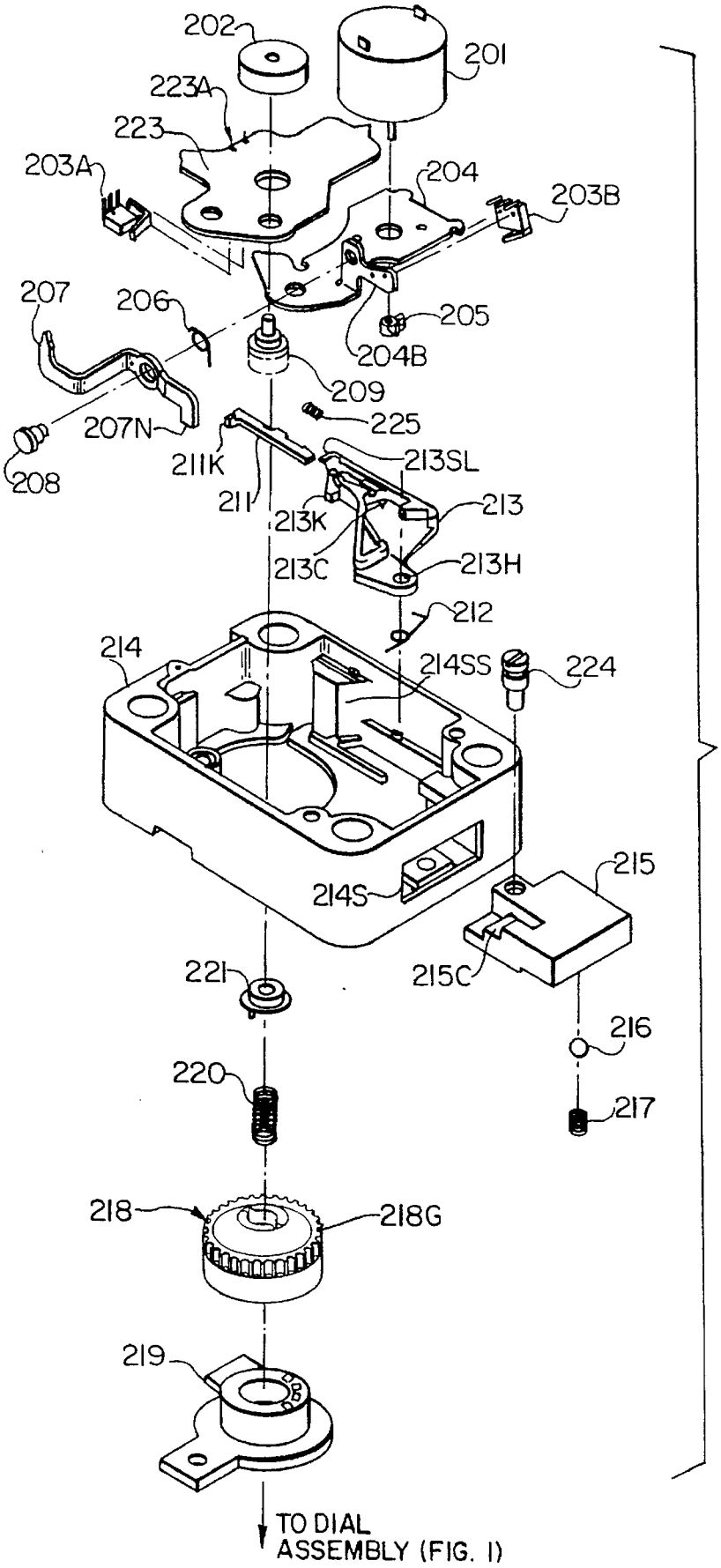
FIG. 2 is an exploded perspective view of a lock mechanism according to a preferred embodiment.

Referring now to FIG. 2, an exploded perspective view of a preferred lock mechanism is illustrated. A lock case 214 supports, houses and protects elements of the lock mechanism.

A drive cam 218 is integrally linked with inner dial 102 (FIG. 1), such as via a hexagonal rod 109 (shown in 1). Thus, in a typical embodiment, the underside of dial ring 107 (FIG. 1) is physically opposed to the underside of case 214 (FIG. 2), so that a direct linkage of the dial assembly to the lock mechanism is provided. FIGS. 1 and 2 are provided in exploded perspective views merely for purposes of explanation, and it is understood that FIGS. 1 and 2 should be rotated 90 degrees in mutually opposite directions to appreciated their orientation when assembled.

Again referring to FIG. 2, drive cam 218 is rotatably positioned atop a bushing 219. A spring 220 and cam spring retaining bushing 221 are disposed directly above drive cam 218. Cam spring retaining bushing 221 is held in place by a bracket 223 which is mounted directly above the drive cam. The cam spring 220 is captured between the drive cam 218 and the cam spring retaining bushing 221. The mounting position of the bracket 223 in the lock case 214 causes the cam spring to be compressed and hold the drive cam against the hard plate bushing 219.

Drive cam 218 rotates integrally with the inner dial 102 (FIG. 1) by means of the hexagonal spindle 109 disposed along their common rotational axis. In conjunction, the methods embodied in the CPU (described below), and the turning of the drive cam by the inner dial, substantially govern operation of the lock mechanism.

A bolt 215 extends from a slot 214S in case 214 when in the "lock" position, but is withdrawn into the case 214 in its "unlock" position. Bolt 215 is provided with a detent ball 216 and a detent spring 217, providing upward urging on the bolt. In the locked position, this upward urging works in conjunction with the angle of an edge of an angled countersink (not visible) on the bottom of the bolt, to translate the upward force into a longitudinal force in the direction of bolt motion. This force on the angled countersink holds the bolt against its stop in its fully extended position.

The position of bolt 215 is substantially governed by the longitudinal position and angular orientation of a locking lever 213. The locking lever rotates about an axis of rotation defined by a hole 213H. A lever screw 224 fits through the hole 213H into a threaded hole in bolt 215 near the left end thereof. The lever screw 224 ensures that lever 213 and bolt 215 move together, longitudinally.

Locking lever 213 is urged in a counter-clockwise direction (as viewed in FIG. 2) by a lever spring 212, which urges a straight key portion 213K of lever 213 toward drive cam 218. Although not visible in FIG. 2, a slot 218SL (shown in FIG. 4) is provided in drive cam 218 which can engage key 213K when drive cam 218 is in the proper position, as described below.

Locking lever 213 has a slot 213SL which receives a first end of sliding link 211. At the end of sliding link 211 opposite slot 213SL protrudes a small key 211K, which key may engage a tab 218T on drive cam 218, shown in FIG. 4. Further, a compression spring 225 engages the sliding link 211 to hold it in a "rest" position away from motor cam 205.

Mating brackets 204,223 support and position various other elements in the lock mechanism.

A magnet rotor 202 is provided with an axis which is parallel to the axis of drive cam 218. A magnet rotor post 209 is positioned along the axis of magnet rotor 202, and has at its lower end a gear teeth arrangement which mates with gear teeth 218G positioned on top of drive cam 218. The magnet rotor post 209 penetrates a hole in bracket 223 in which it can rotate.

First and second sensor switches 203A, 203B are provided.

First sensor switch 203A is provided at a position 223A on mating bracket 223. Switch 203A senses when the inner dial 102 has been pushed. More specifically, switch 203A directly senses the upward motion (as viewed in FIG. 2) of drive cam 218, which is integrally connected with the inner dial 102. Switch 203A provides a signal to a CPU indicating pressing of the inner dial, as described with reference to FIG. 3B.

Similarly, second sensor switch 203B is provided at a position 204B on bracket 204. Sensor switch 203B senses when the bolt 215 is withdrawn into the case in its unlock position. Switch 203B also provides a signal to the CPU as described with reference to FIG. 3B.

Switches 203A and 203B are retained to respective brackets 223 and 204 by a pivot post and a switch spring (not shown for purposes of clarity). Each pivot post fits in the fight hole (as viewed in FIG. 2) of the two small holes in the respective brackets 204,223. A switch spring, which is preferably in the form of a "U", fits in the left hole (as view in FIG. 2) of the two holes. The switch springs holds the pivot posts in place and urges the switches back to their original position after the overtravel condition is relieved. This mounting arrangement allows the switches to pivot about pivot post when the switch reaches its maximum limit of travel. In this manner, it prevents breakage of the switches.

A bolt motor 201 is provided with an axle which penetrates mating bracket 204. Extending from the bolt motor axle is a motor cam 205. Under control of the CPU (FIG. 3B), the bolt motor causes motor cam 205 to engage or disengage locking lever 213 within a cove 213C of the locking lever 213. The cam is positioned in the cove, beyond the end of the sliding link 211.

As the largest portion of motor cam 205 is rotated upward and to the right (as viewed in FIG. 2), it causes the locking lever 213 to rotate clockwise (as viewed in FIGS. 2 and 5B) into its disengaged (lock) position, away from drive cam 218. Conversely, as motor cam 205 rotates away from this position to its "engage" position (see FIG. 5A), the locking lever 213 is allowed to rotate toward drive cam 218 under the urging of lever spring 212 (FIG. 2).

Also illustrated in FIG. 2, for the sake of completeness, is a re-locker 207, which is rotatably affixed to mating bracket 204 by a re-lock rivet 208. The re-locker element 207 is urged in a clockwise direction (as viewed in FIG. 2) by a re-lock spring 206. The re-locker element 207 acts substantially independently of most other elements in FIG. 2.

In the event that an individual physically forces an object into the lock mechanism, the cover (not shown) of case 214 deforms, causing the re-locker to rotate clockwise (as viewed in FIG. 2). When the re-locker rotates clockwise, a nose portion 207N of the re-locker is inserted into a cove 215C in bolt 215, and into a slot (not visible) inside case 214. When nose 207N is rotated into the slot within case 214, the bolt 215 cannot be withdrawn into the case Because the nose within cove 215C blocks retraction of the bolt.

Figure 3A:
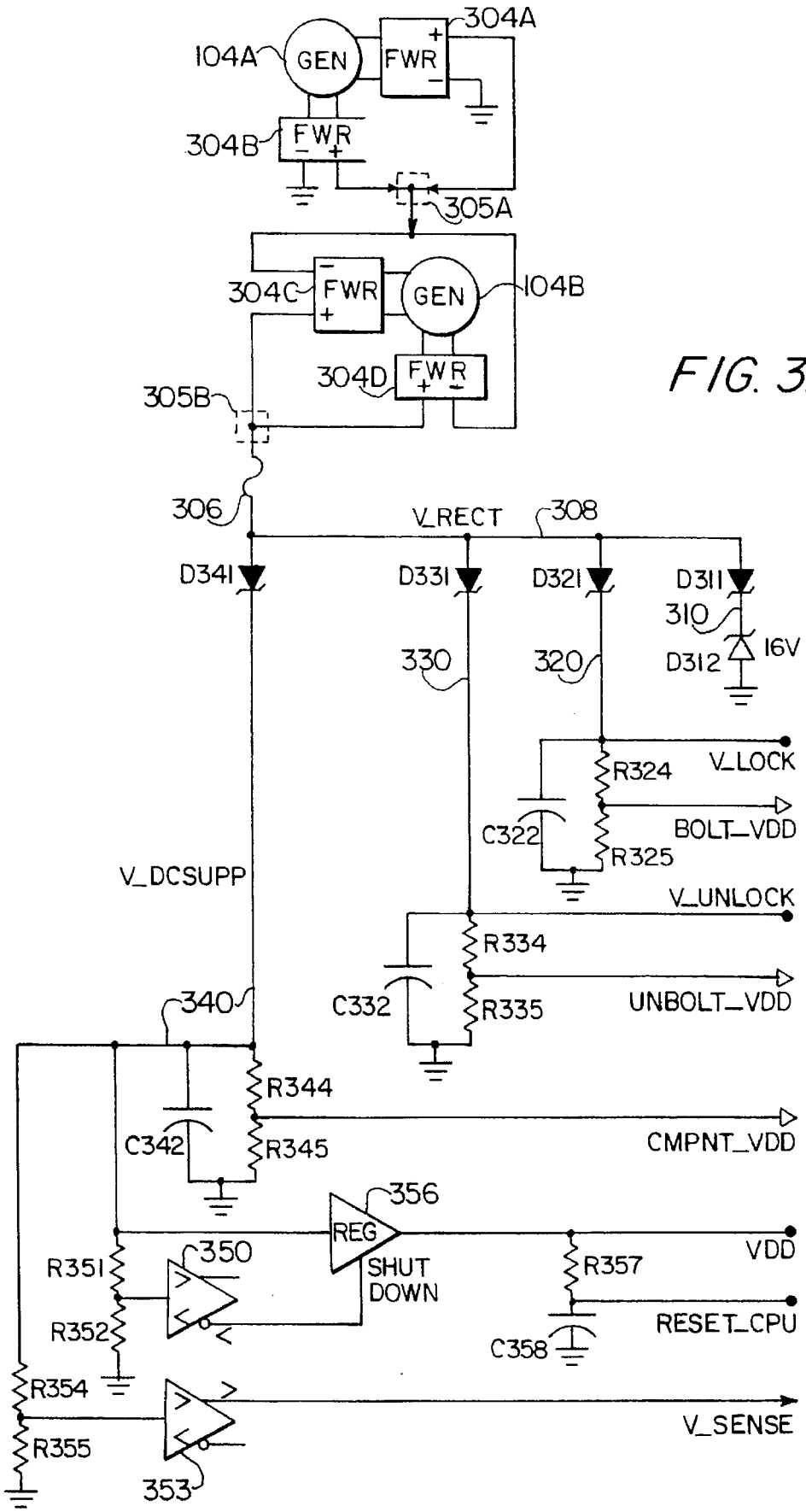
FIG. 3A is a circuit diagram illustrating preferred embodiments of circuitry for producing power levels, power sensing levels, and other signals used in an embodiment of the electronic combination lock.
Figure 3B:
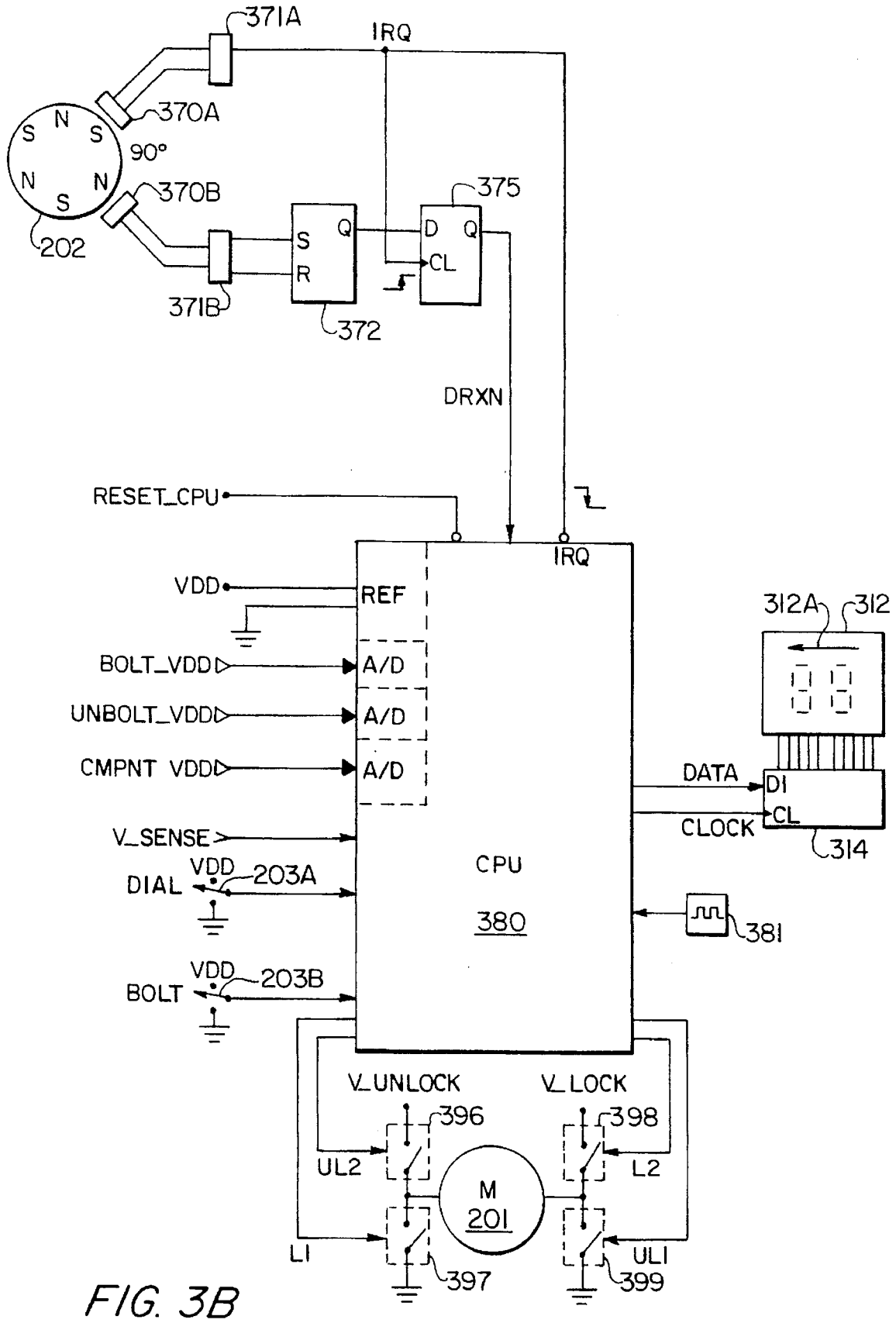
FIG. 3B schematically illustrates a central processing unit (CPU) receiving rotational information from a rotating dial and other information regarding power levels, and controlling a display and motor cam, thus electronically governing operation of an embodiment of the electronic combination lock.

FIGS. 3A and 3B (which may collectively be referred to herein as FIG. 3) show various elements schematically. These elements show the manner in which the various physical elements of FIGS. 1 and 2 are connected by electronic elements, and function as in the flow charts in FIGS. 6 and 7 (described below).

Referring to FIG. 3A, circuitry for converting generated electricity into DC power for operation of the lock, is illustrated. Generators 104A, 104B (FIG. 1) are illustrated in FIG. 3A connected to respective pairs of full wave rectifiers ("FWRs") 304A, 304B and 304C, 304D. The negative terminals of FWRs 304A and 304B are grounded, while the positive terminals are wired together to effectively form a summing junction 305A. The sum from junction 305A feeds the negative terminals of FWRs 340C and 304D. The positive terminals of FWRs 304C and 304D are wired together to effectively form a summing junction 305B.

A fuse 306 is located on a path between the summing junction 305B and a node 308. Node 308 has a voltage V_RECT, which is a rectified DC voltage resulting from the full wave rectified outputs of the generators. V_RECT is not a regulated voltage.

Node 308 is connected to nodes 310, 320, 330, and 340 by respective diodes D311, D321, D331, D341. The dimes D311, D321, D331, D341 ensure current cannot pass from any one of nodes 3 10, 320, 330, 340 to any other of these nodes.

A Zener diode D312 leads from ground to node 310, and ensures that the voltage on any of nodes 310, 320, 330 or 340 does not exceed a given set amount, chosen in accordance with the tolerances of the electronic components or capacitor. In a preferred embodiment, diode D312 is 16 volt Zener diode.

A capacitor, or, preferably, capacitor bank, C322 is provided between ground and node 320. In parallel with C322 is a voltage divider including resistors R324 and R325. The intermediate node between R324 and R325 is labeled BOLT_VDD, and is an analog voltage which is monitored in a manner described below. Node 320 has a voltage V_LOCK, which is supplied to power motor 201 (FIGS. 2, 3B) to move motor cam 205 (FIG. 2) as described below.

Node 330 is separated from ground by a capacitor, or, preferably, capacitor bank, C332. In parallel with C332 is a voltage divider including resistors R334 and R335. Node 330 has a voltage V_UNLOCK which also provides power to the motor 201 (FIGS. 2, 3B) to move the motor cam 205 in the opposite direction as when voltage V_LOCK powers the motor. The intermediate node between R334 and R335 is labeled UNBOLT_VDD, and is an analog voltage which is monitored in a manner described below.

Node 340, with voltage labeled V_DCSUPP, is connected to ground via a capacitor, or, preferably, capacitor bank. C342. In parallel with C342 is a voltage divider including resistors R344 and R345. The intermediate node between R344 and R345 is labeled CMPNT_VDD, an analog voltage which is monitored in a manner to be described below.

Various elements derive power from V_DCSUPP on node 340. For example, a voltage underdetector 350, a voltage overdetector 353, and a voltage regulator 356 derive power from node 340. The powering of these elements is not explicitly shown in FIG. 3A, for purposes of clarity.

Voltage regulator 356 provides VDD from V_DCSUPP, which governs operation of the electronic component shown in FIG. 3B such as the flip-flops, CPU, display elements, and shift register.

Voltage underdetector 350 is shown schematically, with its input connected to an intermediate node of a voltage divider having resistors R351 and R352. R351 and R352 connect node 340 to ground. When undervoltage detector 350 determines that the voltage on node 340 has fallen below a certain level, its output leading to the shutdown input of voltage regulator 356 is activated. In this manner, when the voltage on node 340 falls below a certain critical level required for proper operation of the electronics. regulator 356 is deactivated and VDD=O.

An R-C combination in a low-pass filter configuration connects VDD to ground. The node between resistor R357 and capacitor C358 is a RESET_CPU signal which remains low for a given time after VDD is initially powered up. The RESET_CPU signal is used to reset a central processing unit (CPU) 380 (FIG. 3B). In a preferred embodiment, this reset pulse lasts approximately 20 milliseconds, to initialize the CPU.

The input to voltage overdetector 353 is connected to an intermediate node of a voltage divider including resistors R354 and R355. When the voltage at node 340 is determined as being above a certain threshold deemed necessary for proper operation of the electronic components, the output of voltage over detector 353 is activated: This digital output, labeled V_SENSE, is provided to the CPU 380 (FIG. 3B).

Thus, circuitry on FIG. 3A provides various types of signals for use by the other electronic components on FIG. 3B. V_LOCK and V_UNLOCK, as well as VDD, provide power to appropriate components. VOLT_VDD, UNBOLT_VDD and CMPNT_VDD are analog voltages which are measured at stamp to ensure that adequate power is available for a complete operational scenario. V_SENSE is a digital signal providing a binary indication of the sufficiency of the voltage VDD to the electronic components. Finally, the RESET_CPU signal is a short signal which initially resets the CPU when the electronic circuitry is initially powered up by the generators.

Referring now to FIG. 3B, various other elements related to operation of the combination lock are illustrated.

Magnet rotor 202 is illustrated schematically. In an exemplary embodiment, magnet rotor 202 has three pairs of north-south poles arranged in an alternating pattern about the rotor. Two Wiegand sensors 370A, 370B are arranged at a 90° offset to each other, with respect to the axis of rotation of the magnet rotor.

The nature and operation of Wiegand elements is described in literature available to those skilled in the art, for example, "The Wiegand Effect, What's It All About" from Sensor Engineering Company, an Echlin Company, 21555 State Street, Hamden, Conn., 36517, which is incorporated herein by reference. The document describes principles of operation and a particular commercially available Wiegand sensor (pan no. 110-00057-000).

Essentially, as magnet rotor 202 rotates with the user's turning of the inner dial 102, each sensor generates pairs of alternate-polarity, short-duration predictable voltage pulses whose magnitude and duration are substantially independent of the speed of rotation of the magnet rotor. In this manner, operation of the inner dial is made more predictable than purely inductive sensing, while retaining the advantage that no power needs to be provided to generates the pairs of pulses at the output of sensors 370A, 370B.

A first pulse shaping element 371A responds to the opposite-polarity pairs of pulses from the Wiegand element 370A, and provides an interrupt request signal IRQ to CPU 380. In the illustrated embodiment, the falling edge of the IRQ signal interrupts the CPU. Thus, as magnet rotor 202 turns, sensor 370A produces pulse pairs which element 371A converts into a wider digital pulse whose falling edge causes an interrupt. As the magnetic poles on magnet rotor 202 pass sensor 370A, the CPU 380 is interrupted, so that the CPU can then cause a new number to be displayed to the user.

Wiegand sensor 370B provides pairs of pulses to a second pulse shaping element 371B. In response, element 371B provides digital pulse pairs to the "set" and "reset" ("S" and "R") inputs of an S-R flip-flop 372.

The output of S-R flip-flop 372 is provided to the data input of a D-type flip-flop 375. The clock input of D-type flip-flop 375 is triggered by the rising edge of the IRQ IRQ signal from element 371A. The clocked output of flip-flop 375 is a direction-indicating signal DRXN which is provided to the CPU 380.

In operation, the signals entering S-R flip-flop 372 are either a set pulse immediately followed by a reset pulse, or a reset immediately followed a set pulse. The order of the pulse pairs is determined by the direction of rotation of magnet rotor 202. As a result, the output of S-R flip flop 372 after the second pulse of a pulse pair is determined by the direction of rotation of magnet rotor 202.

At a time after the pulse pair is encountered, the rising edge of the IRQ signal clocks the direction-indicating signal at the output of S-R flip-flop 372 into D-type flip-flop 375. Thus, when a user rotates magnet rotor 202, the output of D-type flip-flop 375 is a constant binary signal which indicates the direction the user is turning the inner dial.

During operation, the pulses produced by Wiegand sensor 370A cause an interrupt of CPU 380 on the falling edge of the IRQ signal from element 371A. In servicing the interrupt, CPU 380 samples the DRXN signal which is stably registered in flip-flop 375 by the rising edge of the IRQ signal. In this manner, the CPU can determine whether to increment or decrement the number it causes to be displayed to the user on a display 312, described below.

Also illustrated in FIG. 3B are various signals and levels which are generated on FIG. 3A. For example, the analog voltage levels, BOLT_VDD, UNBOLT_VDD and CMPNT_VDD are input to respective analog-to-digital converters within the CPU. The signal VDD and ground provide reference levels for the conversion to digital signals.

Also, the V_SENSE binary signal is sampled directly by the CPU.

Switches 203A, 203B are schematically illustrated as respective two-position switches which may be connected either to VDD or to ground. Switch 203A senses whether inner dial 102 (FIG. 1) has been pushed, and switch 203B senses whether the bolt 215 (FIG. 2) has been withdrawn. Further switches (not shown) may be provided in a similar configuration to perform other functions. For example, it may be desirable to allow a user to request a change of combination, a request which should be recognized only when the bolt is retracted. This functionality is readily built into the CPU software. The RESET_CPU signal is shown connected to the active-low reset input of the CPU.

Also, a suitable timing source, such as a crystal oscillator 381, is illustrated.

The CPU 380 also outputs two pairs of binary signals which govern the position of electronic switches 396, 397, 398, 399. Switches 396 and 397 are connected in series between V_UNLOCK and ground. Switches 398, 399 are connected in series between V_LOCK and ground. The motor 201 (FIG. 2) is connected between the respective intermediate nodes between switches 396 and 397, and between switches 398 and 399.

In operation, when the CPU determines that the motor is to turn motor cam 205 in a direction to allow the bolt to unlock, then switches 396 and 399 are turned on, so that current passes from V_UNLOCK through switch 396, the motor 201, and switch 399 to ground. The motor turns the motor cam into a position shown in FIG. 5A.

Conversely, when the CPU determines that the motor should turn motor earn 205 to prevent the user from withdrawing the bolt, then it causes switches 397 and 398 to close, so that current passes from V_LOCK through switch 398, motor 201, and switch 397 to ground. The motor turns the motor cam into a position shown in FIG. 5B.

Of course, when the CPU determines that the motor should be inactive, all switches 396, 397, 398, 399 are left open, and no power is consumed by the motor.

CPU 380 governs a display element 312. The illustrated display element includes two LCD numeric displays 312, and an arrow element 312A. CPU 380 passes data to a shift register 314 associated with the displays using data and clock signals in a manner easily appreciated by those skilled in the art. The bits are decoded by logic within the display element, so as to provide a visual display of numerals to the operator.

In an exemplary embodiment, which should in no way limit the scope of the invention as defined in the claims, the following particular implementations of various elements may be chosen. The total capacitance of elements C322 and C332 may be the same. However, because capacitor bank C342 powers all the electronic components, its capacitance should be approximately four times that of the C322 and C332 capacitor banks. Of course, the particular implementation of the electronics would determine an optimum design for the capacitor banks. Overvoltage and undervoltage detectors 350, 353 may be implemented using an ICL 7665SIBA. Voltage regulator 356 may be implemented as an ICL 7663SIBA, and produce a 3.1 volt output for the electronics from an approximately 16 volt unregulated input. Suitable by-pass capacitors may extend between VDD and ground, as deemed necessary. Flip-flops 372, 375 may be implemented as part of a single 4013 integrated circuit package. CPU 380 may be implemented as a 68HC805B6, available from, Motorola, Inc. The reference voltage of Zener diode D312 may be 16 volts, and correspond to the maximum capacitance of the capacitors in the capacitor banks C322, C332 and C342. The full wave rectifiers 304A–D may be of conventional design, with the time-domain summation elements 305 simply being a wire connection between the outputs of the full wave rectifiers. The shift register 314 may be implemented in any suitable serial-in-parallel-out shift register. Of course, variations and substitutions of these elements, and of the magnitude and nature of the electrical quantities which they produce, lie well within the capability of those skilled in the art.

Briefly, the electronic combination lock of FIGS. 1–5B functions as follows.

At startup, the CPU monitors UNBOLT_VDD and V_SENSE (and also BOLT_VDD if desired) to determine when it is appropriate to begin an operational scenario. In practice, immediately after startup, the CPU does not begin its main operation until it senses that UNBOLT_VDD is large enough, and V_SENSE is activated. After sufficient power has been generated and stored in capacitor bank 330, the electronic combination lock may operate fully. A similar monitoring may be performed on BOLT_VDD.

In a particular preferred embodiment, the display is turned on only after sufficient power has been generated and stored, by operation of the outer dial. In this embodiment, the activation of the display indicates to the user that he does not need to turn the outer dial any more.

As the inner dial is turned, the dial position is encoded through use of the magnet rotor 202 and the Wiegand effect sensors 370A, 370B. CPU 380 recognizes the signals derived from the pulses generated in response to Wiegand elements, and the CPU causes the position indicator LCDs 312 to indicate increasing or decreasing numerical values.

When the inner dial is pushed (presumably to indicate the user believes the displayed number is one number in the numerical combination), sensor switch 203A is closed, thus informing CPU 380. CPU 380 reads the change of state of the switch 203A and accepts the displayed number as part of the believed combination, storing the number internally. This process of entering successive numbers of the combination is repeated for successive numbers of the believed combination. Then, the following occurs in the mechanical elements.

However, when a correct combination is input through operation of inner dial 102, the lock may be put into its unlocked position in the following manner. The electronic circuitry recognizes the sequential entry of combination numbers through repeated pushing of inner dial 102. The CPU 380 causes application of electrical current to bolt motor 201 so as to rotate motor cam 205. The motor cam 205 rotates within cove 213C on the locking lever 213 to allow the locking lever to rotate counter-clockwise (in FIGS. 2 and 5A) under the urging of spring 212. As the locking lever 213 rotates counter-clockwise, the key 213K engages a notch in the drive cam. Then, as the user rotates inner dial 102 clockwise (which translates to counter-clockwise motion as viewed in FIG. 2), the bolt is retracted as locking lever 213 pulls bolt 215 into the cage 214.

To lock the mechanism after it has been unlocked, the following occurs. The inner dial is turned counter-clockwise in FIG. 1, which corresponds to clockwise motion in FIG. 2. Because the key 213K (FIG. 5) is mated with the slot 218SL in drive cam 218 (FIG. 4), the bolt 215 is moved toward its locked (extended) position. As the inner dial is turned further, the key 213K is pushed out of the drive cain's slot 218SL because of the rounded shape of the key 213K. After the locking lever is disengaged from the drive cam, a tab 218T (FIG. 4) on the side of the drive cam engages the link key 211K (FIG. 2). Continued rotation of the inner dial causes continued motion of the sliding link 211 to engage the motor earn 205 and cause it to rotate clockwise. As it rotates clockwise, motor cam 205 raises locking lever 213 so that the key 213K can no longer engage the slot 218SL in drive cam 218. Thus, in order for the inner dial (and the drive cam) to move the bolt into the case again, the correct combination must again be dialed.

When the bolt 215 is extended in its lock position, it cannot move back into the lock case 214, because of the position of the locking lever 213. This is because the motor cam 205 rotates the locking lever clockwise (as viewed in FIGS. 2 and 5B) into a position to hold it away from the slot 218SL in the drive cam 218, and against a stop surface 214SS in the case. If force is applied directly to the bolt 215 to attempt to force it into the case 214, motion of the lever 213 and bolt 215 is prevented by virtue of the position of stop surface 214SS.

It will be appreciated by those skilled in the an that the charge stored in V_UNLOCK is used up very quickly by the motor in moving the motor cam after a correct combination entry. In contrast to V_UNLOCK, V_DCSUPP normally lasts much longer than needed to allow the user to withdraw the bolt. When a sufficient length of time has not passed between successive locking openings, the voltage supplying power to the electronic components, V_DCSUPP, is still at a high enough level to allow the lock to operate. However, in this situation, there would not be a sufficient charge in V_UNLOCK. For this reason, a separate sensing signal is used to monitor the magnitude of V_DCSUPP and V_UNLOCK to ensure proper startup operation.

This monitoring feature is supplemented by a "timeout" feature, as follows.

According to a preferred embodiment, after the CPU causes the bolt motor 201 to rotate the locking lever 213 counter-clockwise to engage the drive cam 218, an "opening time window", preferably about 20 seconds, is created in the software. During this window, the bolt must be retracted by turning the inner dial. If the inner dial is not properly turned in the manner required to open the lock, the window ends, the motor rotates the motor cam 205 to rotate locking lever 213, and the correct combination must again be dialed to retract the bolt.

To achieve this "timeout" feature, the electrical interlock switch 203B senses if the lock bolt 215 has been drawn within the case 214 a sufficient distance. If the lock bolt 2 15 has not been retracted, the switch will not have changed the state within the time window. Accordingly, the CPU reverses motor's direction and turns the motor cam 205 so as to move the locking lever away from the drive cam. In this position, the locking lever is rotated clockwise as seen in FIG. 2, and it cannot engage the drive cam 218 until a correct combination is entered.

Figure 4:
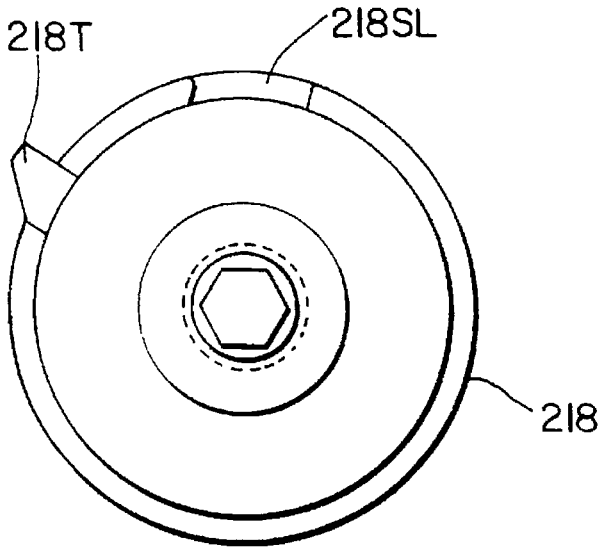
FIG. 4 illustrates a preferred drive cam 218 (FIG. 2), showing details thereof.

FIG. 4 illustrates drive cam 218 in more detail, with its slot 218SL and tab 218T. Slot 218SL is provided for engagement with key 213K on locking lever 213. Tab 218T is provided for engagement with sliding link key 211K. The purpose and function of these elements in the electronic combination lock are described above.

Figure 5:
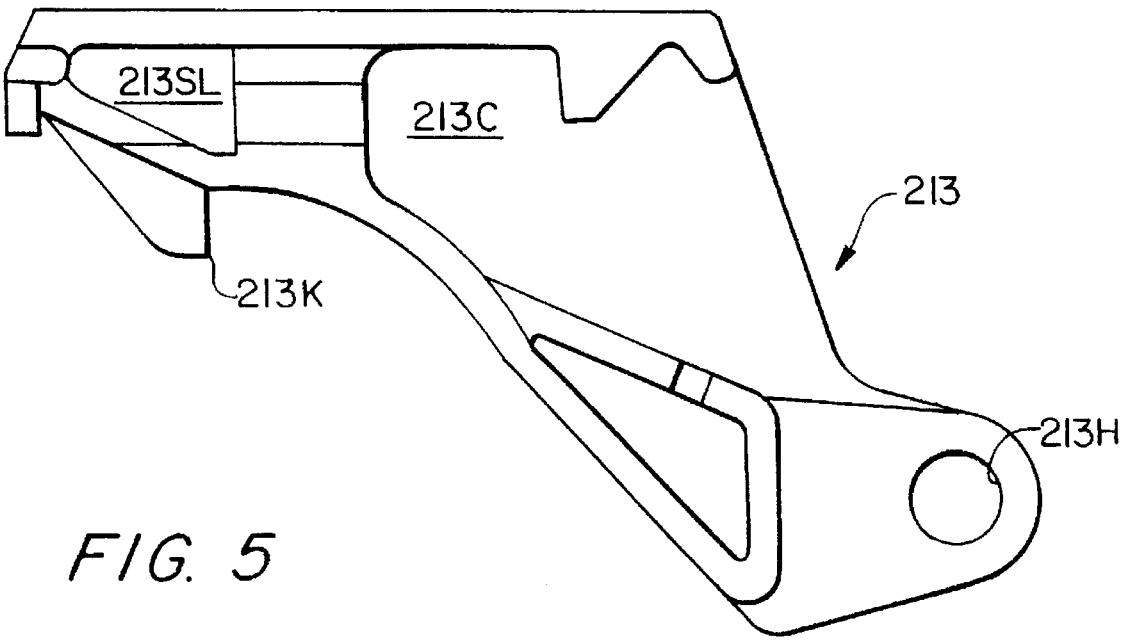
FIG. 5 is an enlarged view of the locking lever 213 (FIG. 2), with FIGS. 5A and 5B showing relative orientation of the motor cam 205 in relation thereto in the engage and disengage (lock) position.

FIG. 5 (not in exact proportion to FIG. 4) illustrates the portions of locking lever 213 in more detail, including the following: slot 213SL for receiving sliding link 211; key 213K for engaging drive cam 218; cove 213C in which bolt motor drive cam 205 operates; and pivot hole 213H about which the locking lever rotates, and into which fits lever screw 224 which is threaded into a corresponding hole in bolt 215.

Figure 5A:
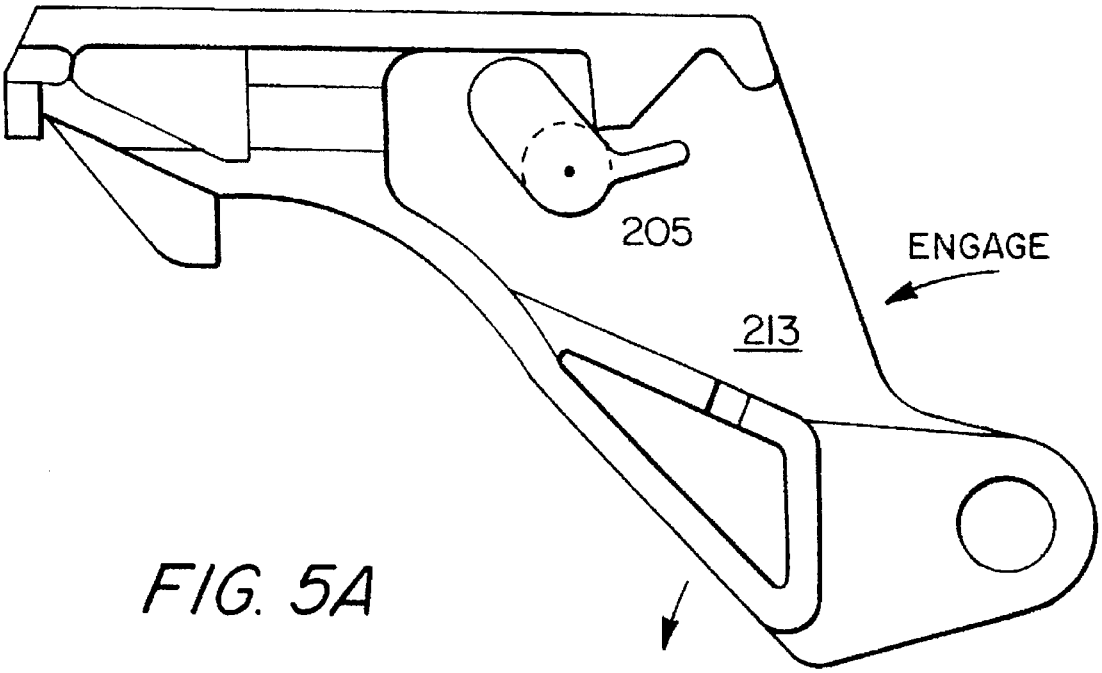
Figure 5B:
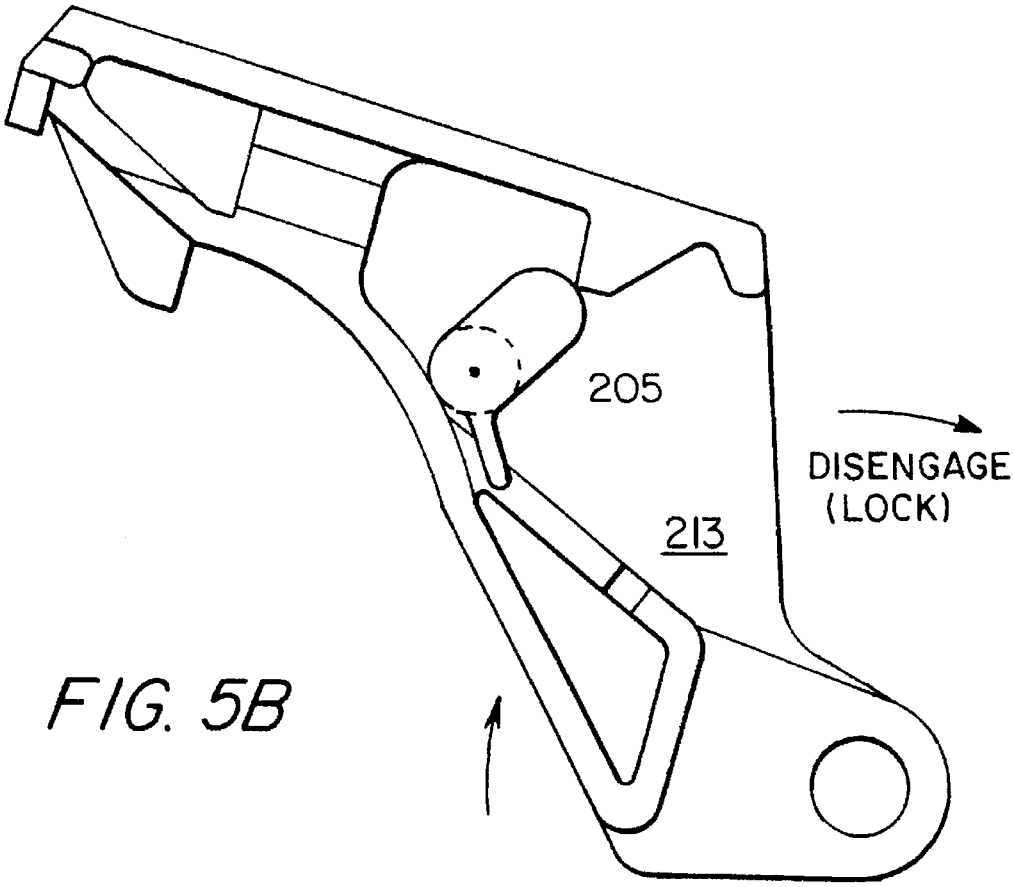

FIGS. 5A and 5B illustrate the relative position of the locking lever 213 and motor cam 205 in the unlock (engage) position and lock (disengage) positions, respectively, as referred to repeatedly above.

Figure 6:
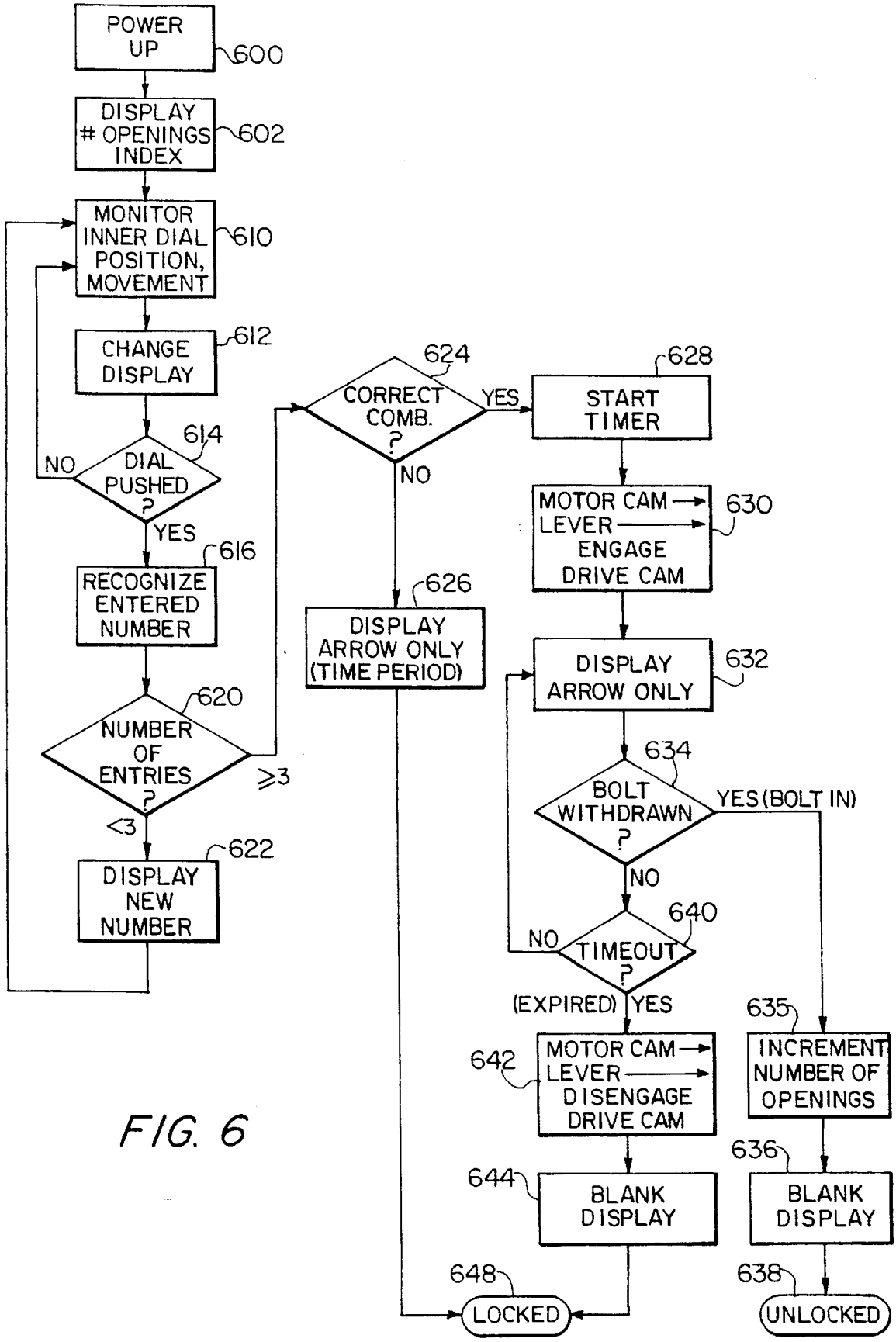
FIG. 6 is a flow chart illustrating single user operation of the preferred electronic combination lock.

Referring now to FIG. 6, a flow chart of the operation of the electronic combination lock is illustrated. For purposes of clarity, the flow charts in this specification omit incidental and bookkeeping tasks which are understood by those skilled in the an to be present and necessary. For example, index (counting) variables are not explicitly shown to be initialized or incremented, because a specific illustration and description of such initialization are not required for description of the invention and are not necessary for those skilled in the art to make and use the invention. Those skilled in the art are readily capable of properly initializing and incrementing index variables, without undue experimentation.

The method illustrated in FIG. 6 may be implemented in software or firmware in CPU 380 (FIG. 3). Preferably, the software or firmware is embedded in a read only memory (ROM) within the CPU. The ROM is connected to the processor in the CPU by suitable address, data, and control buses as readily appreciated by those skilled in the art, and found in commercially available CPUs. Because the detailed implementation of the internal structure of the CPU is not essential to the invention that is being claimed, and because this structure is readily capable of implementation or commercial purchase by those skilled in the art, it is not further discussed here.

Referring to FIG. 6, the user spins outer dial 101 (FIG. 1) so as to provide power to the electronic components. This procedure, indicated in block 600, is carried out using the circuitry shown in FIG. 3A.

Thereafter, as indicated at block 602, the CPU causes display element 312 to display an index number representing the number of times that the look has previously been opened. This feature advantageously informs the user of any unauthorized openings of the look. For example, if, on a Friday afternoon, a bank officer opened the lock and saw a "47" displayed but then, on Monday morning, opened the look to find a "49" displayed (instead of the "48" he would expect), he would know that over the weekend another individual had opened the look.

After these preliminary steps 600 and 602, control passes to a loop whose first functional block is block 610.

In block 610, the CPU monitors the movement of the inner dial. This is done by receiving signals from pulse shaper 371A and flip-flop 375 (FIG. 3B), as described above.

In response to the monitored movement and position of the inner dial, the CPU changes the display 312 to provide visual feedback to the operator that his rotation of the inner dial is being recognized. This ongoing change of display is reflected at block 612.

Decision block 614 causes control to branch, based on whether or not the inner dial has been pushed by the operator. This is sensed by the sensor switch 203A (FIG. 3). If the inner dial has not been pushed, control returns to block 610 for continued monitoring of the position and movement of the inner dial. However, if the CPU detects closure of dial switch 203A, control passes to block 616.

At block 616, the CPU recognizes the present number output to display element 312 as being a number which the operator believes is part of the combination. The CPU stores this number in RAM for comparison with the programmed combination of the particular combination lock which has previously been stored in a non-volatile memory.

Control then passes to decision block 620. At decision block 620, the CPU decides whether the total number of times that the dial has been pressed, is the same as the quantity of numbers that are in the combination. Usually, there are three numbers in the combination.

If less than the total quantity of numbers in the combination have been entered, control passes to block 622. At block 622, the CPU causes display element 312 to immediately display another number, which in the preferred embodiment is different from the number selected by the operator. Then, control passes back to block 612, in which the CPU monitors the position and movement of the inner dial.

More specifically, in block 622, the CPU may execute an algorithm which causes display of a different number. Essentially, the preferred algorithm is a non-random offset number display which is sufficiently different from the selected number to immediately hide the selected number from people spying on the operator. This feature also provides the advantage of defeating auto-dialers.

Referring again to FIG. 6, if decision block: 620 determines that three selections have been entered, control passes to decision block 624. At block 624, the CPU compares the numbers in the permissible combination or combinations to the series of selected numbers which the operator has entered. If the series of selected numbers do not match a proper combination, control passes to block 626.

At block 626, the CPU blanks the number display and causes the display element 312A to display an arrow for a given period of time such as 20 seconds, as if a correct combination had been entered. However, from this time on, the CPU recognizes the lock as being in a "locked" state as indicated by lock 648. After 20 seconds, the entire display is blanked and the lock cannot be opened.

If, however, decision block 624 determines that the series of selected numbers matches a combination, control passes to block 628. At this time, a 20-second timer is activated. The 20-second timer defines a 20-second time window which is used for purposes described below.

At this time, it is known that a correct combination has been entered. Therefore, block 630 reflects the CPU's activation of the motor (FIG. 3). CPU 380 causes motor 201 (FIG. 2) to rotate motor cam 205 (FIGS. 2 and 5A) to allow the locking lever 213 to engage drive cam 218. Thereafter, control passes to block 632.

At block 632, the CPU causes the numerals to be blanked from display element 312, but displays an arrow 312A to be shown to the user. The arrow instructs the user to rotate the inner dial clockwise to mechanically open the lock. Then, control passes to decision block 634.

At block 634, the CPU determines whether bolt withdrawal detection switch 2038 has changed state, to indicate that bolt 215 (FIG. 2) has indeed been withdrawn. If the bolt has not yet been withdrawn, control passes to decision block 640.

At decision block 640, the CPU determines whether or not the 20-second time period started in block 628 has expired. If the time period has not expired, control passes to block 632, repeating the loop in which the state of bolt withdrawal detection switch 203B is sensed. When the bolt has been withdrawn into the case, control passes from decision block 634 to block 635.

At this time, the index reflecting the number of times that the lock has been opened is incremented. This index number is stored for later use by block 602. This number is preferably stored in a non-volatile memory, such as an electrically erasable programmable read only memory (EEPROM) resident within the CPU, so that the number will be preserved over the substantial periods of time between the occasions on which the locked is opened.

Immediately thereafter, the entire display is blanked at block 636, and the CPU recognizes the lock to be in the "unlocked" state, as indicated at block 638.

Returning to discussion of decision block 640, if the 20-second time window has expired, control passes from decision block 640 to block 642. At block 642, the motor cam is rotated so as to rotate the locking lever 213 away from drive cam 218, as shown in FIG. 5B. This prevents opening of the lock, even if the drive cam 218 is rotated. In order to open the lock, a correct combination must again be entered.

After the locking lever is moved away from the drive cam, the display is blanked, as shown at block 644. The CPU recognizes the lock to be in the "locked" sate, as indicated at block 648.

In the preferred embodiment, if at any time during the procedure of FIG. 6, a period of 20 seconds elapses between consecutive steps, the CPU blanks the display, and the entire process must be started from block 600. This eventuality is not specifically displayed in FIG. 6, to keep FIG. 6 as clear as possible. Those skilled in the art will readily be able to implement this feature without undue experimentation, given the present description, especially that related to FIGS. 3A and 3B. Therefore, the particular software or firmware needed to accomplish it is not further discussed here.

Figure 7:
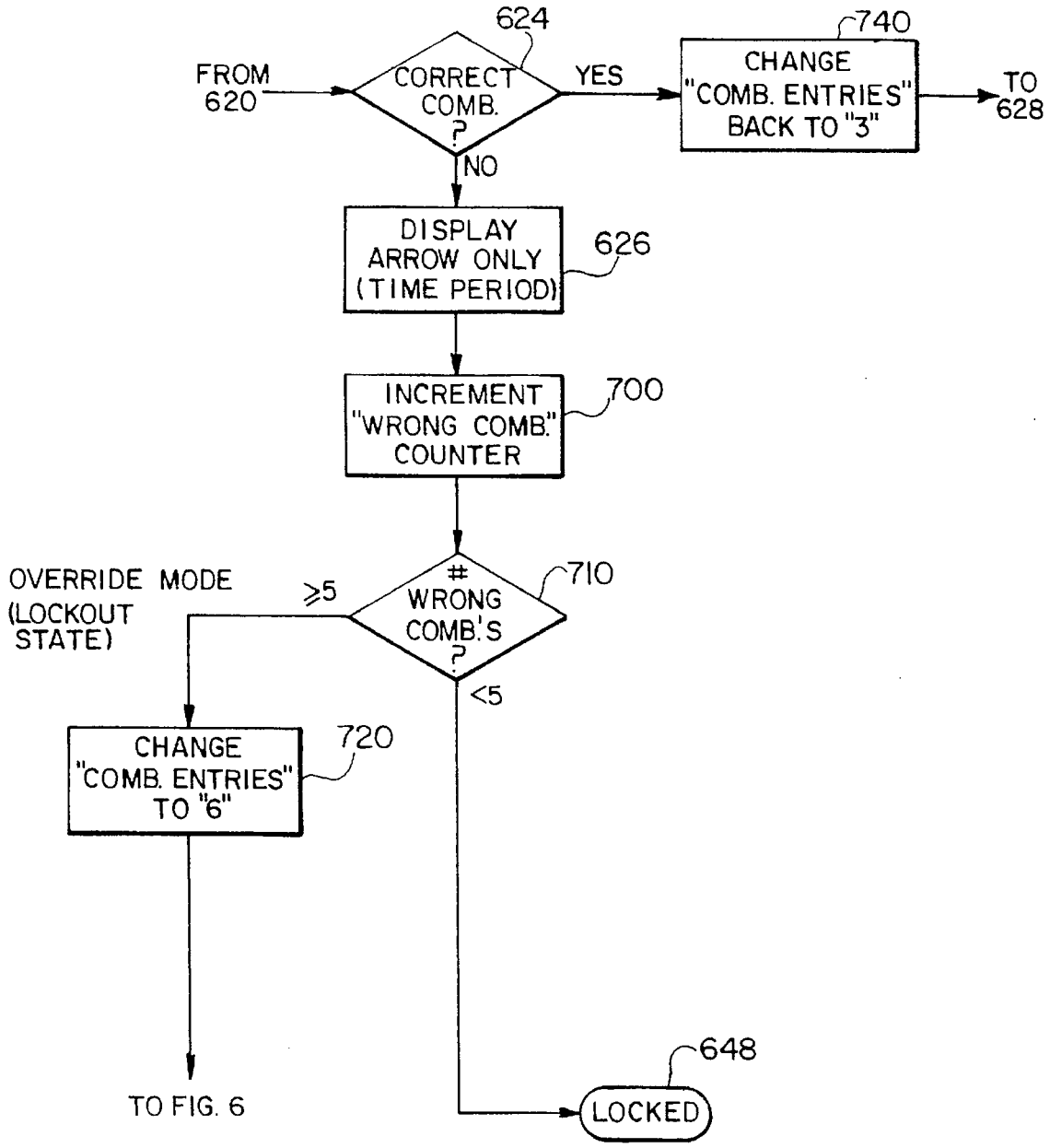
FIG. 7 is a flow chart supplementing the flow chart of FIG. 6, illustrating the "lockout" state entered when a user has entered a given number of incorrect combinations.

Referring now to FIG. 7, the "lockout" feature of the present invention is illustrated in flow chart form.

Referring to FIG. 7, the decision block 624, the display block 626, and the LOCKED state block 648 are copied from FIG. 6. Inserted after block 626 are a counter increment block 700 and a decision block 710.

At decision block 710, the CPU determines whether or not the number of successive incorrect combinations entered has grown to a certain number, for example, 5. If less than five incorrect combinations have been entered successively, control passes to block 648 in the same manner described with reference to FIG. 6.

However, if the user has entered five successive incorrect combinations, the system enters the "lockout" state. Briefly, the lockout state provides that no one can open the lock, even with the "correct" three-number combination processed in FIG. 6. To open the lock in the lockout state, a user must enter an "override" combination. In the preferred embodiment, the override combination has six numbers, as compared to three numbers discussed above in the combination processed in FIG. 6.

Referring again to FIG. 7, as the lockout state is entered control passes to block 720.

At block 720, a "number of entries" parameter, which is used for comparison in block 620 (FIG. 6), is changed from 3 to 6. More generally, block 720 indicates a change in a "number of entries" parameter from the quantity of numbers in the "normal mode" combination to the quantity of numbers in the override combination.

It is understood that block 720 can be implemented in a variety of ways. For example, an override combination may be chosen which is a mathematical variation of the normal mode combination. This choice of override combination facilitates the user's remembering the override combination, while reducing the number of separate combinations which must be stored in the non-volatile memory.

After block 720, control passes to the top of FIG. 6. The system responds as in the mode described with reference to FIG. 6, except that the comparisons performed in blocks 620 and 624 have been altered by FIG. 7 block 720.

When a correct override combination has been entered, as recognized at block 624, the system exits the lockout mode and reenters normal mode. Control passes to block 740. Block 740 performs the reverse operation performed by block 720. Specifically, the "number of entries" parameter is changed back to 3. When the lock is later used, it will be in the normal mode upon power-up.

FIG. 8 illustrates several elements from FIG. 1. The elements in FIG. 8, which are not illustrated to the same scale as each other, demonstrate the tamper-resistant and tamper-evident features of a preferred embodiment.

Referring to FIG. 8, the bearing/retaining member 106 for inner dial 102 is illustrated. The bearing/retaining member 106 fits within the cylindrical portion in the center of dial ring 107.

Similarly, a plurality of bearing/retaining members 105 are provided to bear and retain outer dial 101.

In more detail, bearing/retaining member 106 is provided with three inner tabs offset from each other by 120°, only two tabs of which, 862,864, are illustrated. Each inner tab is provided on a bendable tongue member, one of which is illustrated as element 866. As inner dial 102 is inserted within beating/retaining member 106, tongue 866 yields outward to allow passage of the lower portion of inner dial 102. As inner dial 102 is fully inserted in member 106, tabs 862, 864 snap into a milled slot 820 provided about the circumference of the inserted portion of dial 102. In this manner, after inner dial 102 is inserted in its bearing/retaining member 106, it cannot be removed, because of the locking action of 862, 864, and slot 820.

Also illustrated in FIG. 8 is one of the three outer tabs 860 which are provided on the outer face of bearing/retaining element 106. Tab 860 is provided on its own tongue, and yields as it is inserted into a hollow cylindrical portion of the dial ring 107. When the bearing/retaining member 106 is fully inserted in the dial ring 107, tab 860 fits within an annular slot 868 in dial ring 107. In this manner, bearing/retaining member 106 cannot be removed from dial ring 107 without leaving physical evidence of its removal.

The three tabs such as element 860 are offset 60° from tabs such as elements 862, 864. Thus, bearing/retaining element 106 is provided with six yielding tongues of two types which are arranged in an alternating pattern about the circumference.

Outer dial 101 is retained in the following manner. Bearing/retaining member 105, an exemplary one of three such members shown in FIG. 1, is provided with a tongue 856 at whose extremity is provided a hooked structure 850. As the outer dial 101 is lowered into place, the tongue 856 yields until hook structure 850 engages an annular slot 810 on the circumference of the outer dial. The outer dial is thus snapped in place, and may rotate freely with hook members 850 from the plurality of bearing/retaining elements 105 staying within annular slot 810.

Bearing/retaining member 105 is provided with a bearing surface 852 which supports a ring-shaped surface 814 on the bottom face of the outer dial. Also. bearing retaining structure 105 is provided with a slightly concave surface 854 which matches the convex circumferential surface 812 on the outer dial, above slot 810. In this arrangement, bearing/retaining members such as element 105 secure the outer dial in place as it rotates.

Outer dial 101 is provided with a hole 818 through which the knob portion of inner dial 102 may fit. A ring-shaped surface 816 on the bottom part of the edge of hole 818 abuts a corresponding ring-shaped surface 822 on the top face of inner dial 102. The radial extent of surface 822 is greater than that of hole 818, so that the inner dial 102 cannot be removed without either destroying or removing outer dial 101.

During assembly, members 105 and 106 are fixed to the dial ring 107. Then, inner dial 102 is snapped in place. Finally, outer dial 101 is snapped in place.

Using this arrangement, neither the outer dial 101 nor the inner dial 102 can be removed without obvious evidence of physical damage. Inner dial 102, which provides the more sophisticated function of selecting combination numbers, is still further protected, not only by a tab-slot arrangement, but also by the fact that it is secured by the outer dial 101 itself.

Various advantages accrue, from employing the present invention. The listed advantages specifically listed herein of course do not limit the scope of the invention as defined by the accompanying claims.

An advantage of the present invention is its ability to allow the user to enter combination numbers by pressing inner dial 102. Between entry of combination numbers the user may turn the dial in either direction. Depending on the software design chosen, the dial may be rotated any given number of times before the next combination number is entered. The software can be written to limit how many times the dial is rotated before a next number is recognized as being properly entered. The software may, for example, refuse to recognize a number entered after the dial has been rotated in one direction past the correct number more than once.

Another advantage of the present invention is its use of a passive magnetic sensor to sense both the position and direction of the inner dial. The passive magnetic sensors, in the form of Wiegand elements placed close to the magnetic rotor, allow the CPU to count the revolutions of the dial. This arrangement is simple, yet very reliable, because the direct measurements of position do not require any power. In any event, recognition of the operator's selection of a number is based on the CPU's displayed number, and is not based directly on any sensed position of the magnet rotor, thus eliminating false inputs.

Further, the invention's bolt is directly withdrawn and extended through use of mechanical elements, not requiring electrical power or complex and failure-prone gears which am common in the art.

Moreover, the invention's use of a time-out period, such as 20 seconds, to govern various operations as described above, provides additional features of security.

Also, the use of a dual dial, one to generate electricity, and the other to select and enter combination numbers, are not found in known systems.

Of course, the novelty and non-obviousness of the present invention need not be limited to those features exclusively described herein. Further, modifications and variations of the above-described embodiments of the present invention are possible, as appreciated by those skilled in the art in light of the above teachings; For example. different electrical components, different arrangements thereof, and different implementations of the described processes, may be effected by those skilled in the art without varying from the scope of the invention. It is therefore to be understood that, within the scope of the appended claims and their equivalents, the invention may be practiced otherwise than as specifically described.

What is claimed is:

1. A self-powered lock, comprising:

a) a bolt capable of being extended from and withdrawn into the lock;

b) means, responsive to entry of a correct combination, for enabling the bolt to be withdrawn into the lock, the enabling means having:

1) an "engage" position in which the bolt can be withdrawn into the lock; and 2) a "disengage" position in which the bolt cannot be withdrawn into the lock;

c) means within the lock for storing energy for operation of certain components of the lock;

d) means for monitoring an energy level of the storing means; and e) means, responsive to the monitoring means, for preventing the enabling means from moving from the "disengage" position to the "engage" position if the monitored energy level is below a given energy threshold;

wherein the given energy threshold is greater than or equal to an amount of energy required to subsequently move the enabling means from the "engage" position back to the "disengage" position after a predetermined time period.

2. The lock of claim 1, wherein:

the enabling means includes a locking lever which is selectively positionable between the bolt and a mechanism for withdrawing the bolt;

the locking lever's "engage" position is one in which the withdrawing mechanism and the bolt are connected; and the locking lever's "disengage" position is one in which the withdrawing mechanism and the bolt are not connected.

3. The lock of claim 2, wherein the withdrawing mechanism includes:

an externally accessible dial which is linked to the enabling means when the enabling means is in the "engage" position.

4. The lock of claim 1, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

5. The lock of claim 2, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

6. The lock of claim 3, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

7. A self-powered lock, comprising:

a) a bolt capable of being extended from and withdrawn into the lock;

b) means, responsive to entry of a correct combination, for enabling the bolt to be withdrawn into the lock, the enabling means having:

1) an "engage" position in which the bolt can be withdrawn into the lock; and 2) a "disengage" position in which the bolt cannot be withdrawn into the lock;

c) means within the lock for storing energy for operation of certain components of the lock;

d) means for monitoring an energy level of the storing means; and e) means, responsive to the monitoring means, for preventing the enabling means from moving from the "disengage" position to the "engage" position if the monitored energy level is below a given energy threshold;

wherein the given energy threshold is greater than or equal to an amount of energy required after the enabling means can be moved from the "disengage" position to the "engage" position to subsequently move the enabling means from the "engage" position back to the "disengage" position.

8. The lock of claim 7 wherein:

the enabling means includes a locking lever which is selectively positionable between the bolt and a mechanism for withdrawing the bolt;

the locking lever's "engage" position is one in which the withdrawing mechanism and the bolt are connected; and the locking lever's "disengage" position is one in which the withdrawing mechanism and the bolt are not connected.

9. The lock of claim 8, wherein the withdrawing mechanism includes:

an externally accessible dial which is linked to the enabling means when the enabling means is in the "engage" position.

10. The lock of claim 7, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

11. The lock of claim 8, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

12. The lock of claim 9, wherein:

the means for storing energy includes plural energy storage devices;

only a subset of the energy storage devices are sensed by the monitoring means for controlling the preventing means, and other energy storage devices are sensed but not for controlling the preventing means; and the subset of energy storage devices which is sensed for controlling the preventing means is separate from at least one other energy storage device which powers components of the lock other than the enabling means.

13. A method of controlling operation of a self-powered lock having a bolt, a mechanism which has an "engage" position in which the bolt can be withdrawn into the lock and a "disengage" position in which the bolt cannot be withdrawn into the lock, and an energy store for storing energy for operation of components of the lock, the method comprising:

a) receiving charge in the energy store;

b) recognizing entry of a correct combination;

c) sensing an amount of energy in the energy store;

d) comparing the sensed amount of energy in the energy store to a given energy threshold, the given energy threshold being greater than or equal to an amount of energy required to move the mechanism from the "engage" position back to the "disengage" position; and e) moving the mechanism from the "disengage" position to the "engage" position only if the sensed amount of energy in the energy store exceeds the given energy threshold, and preventing the mechanism from moving from the "disengage" position to the "engage" position if the sensed mount of energy in the energy store does not exceed the given energy threshold.

* * * * *